US006263690B1

(12) United States Patent
Sokolean et al.

(10) Patent No.: US 6,263,690 B1
(45) Date of Patent: Jul. 24, 2001

(54) APPARATUS FOR COOLING A ROOM

(75) Inventors: Helmuth Sokolean, Uerikon; Klaus Roschmann, Uznach; Josef Ender, Bichelsee, all of (CH)

(73) Assignee: Barcol-Air AG, Stafa (CH)

( * ) Notice: Subject to any disclaimer, the term of this patent is extended or adjusted under 35 U.S.C. 154(b) by 0 days.

(21) Appl. No.: 09/397,285

(22) Filed: Sep. 16, 1999

Related U.S. Application Data

(62) Continuation-in-part of application No. 09/369,269, filed on Aug. 6, 1999, now Pat. No. 6,082,126, which is a continuation of application No. 08/860,095, filed as application No. PCT/CH96/00387 on Nov. 1, 1996, now Pat. No. 5,996,354.

(51) Int. Cl.[7] ..... F25D 23/12
(52) U.S. Cl. ..... 62/259.1; 62/288; 165/904
(58) Field of Search ..... 62/259.1, 261, 62/285, 288, 515; 165/49, 56, 110, 904, 913, 918

(56) References Cited

U.S. PATENT DOCUMENTS

| | | | | |
|---|---|---|---|---|
| 1,536,446 | * | 5/1925 | Mercer | 62/285 |
| 1,872,728 | | 8/1932 | Gloekler . | |
| 2,498,342 | | 2/1950 | Petticrew | 62/261 X |
| 2,638,754 | * | 5/1953 | Kleist | 62/515 X |
| 2,651,503 | | 9/1953 | Mills | 62/259.1 |
| 2,835,186 | | 5/1958 | Goldsmith | 62/261 X |
| 3,308,635 | * | 3/1967 | Tenniswood et al. | 62/285 X |
| 3,481,154 | * | 12/1969 | Johnson | 165/918 X |
| 3,611,743 | | 10/1971 | Manganaro | 62/298 X |
| 4,291,542 | | 9/1981 | Sminge et al. | 62/156 |
| 4,627,245 | | 12/1986 | Levine | 62/157 |
| 5,216,887 | | 6/1993 | Kadotani et al. | 62/3.2 |
| 5,363,908 | | 11/1994 | Köster | 165/49 |
| 5,495,724 | | 3/1996 | Köster | 62/259.1 |
| 5,598,886 | * | 2/1997 | Criado-Mellado | 165/918 X |

* cited by examiner

*Primary Examiner*—Harry B. Tanner
(74) *Attorney, Agent, or Firm*—Finnegan, Henderson, Farabow, Garrett, & Dunner, L.L.P.

(57) ABSTRACT

In order to cool a room, a cooling element fitted in the ceiling region is cooled to below the freezing point, preferably to about −40° C., during the cooling phases so that condensate forming thereon freezes immediately. During regeneration phases when the room is not in use, the cooling element is defrosted and the melted condensate is caught in a condensate tray beneath the cooling element and drained via a discharge. The great temperature difference between the room to be cooled and the cooling element also makes it possible to obtain a strong cooling effect with a small cooling element, especially by indirect radiation exchange between the room and the cooling element via an intermediate ceiling. The air in the room is also dehumidified since water vapor is deposited on and bonded to the cooling element in the form of ice. Moreover, the cooling element itself is supported by a stand upon a floor, and detachable from the floor so that the cooling element is capable of being relocated to different locations. In addition, the cooling element includes an upwardly facing cooling surface, a downwardly sloping boundary strip, and a condensate tray.

17 Claims, 10 Drawing Sheets

APPARATUS FOR COOLING A ROOM

A. CROSS-REFERENCES TO RELATED APPLICATIONS

This is a continuation-in-part application of U.S. patent application Ser. No. 09/369,269, filed on Aug. 6, 1999, U.S. Pat. No. 6,082,126, which is a continuing application of U.S. patent application Ser. No. 08/860,095, filed on Jan. 16, 1998, now U.S. Pat. No. 5,996,354, which was filed as International Application No. PCT/CH96/00387 on Nov. 1, 1996, both of which are incorporated by reference herein.

B. FIELD OF THE INVENTION

The invention relates to an apparatus for cooling a room by radiant heat exchange.

C. DESCRIPTION OF THE RELATED ART

It is known (see for example H. Sokolean: "K ühldeckentechnologie zur Erreichung des bestmöglichen Raumkomforts", [Cooling-ceiling technology for achieving the best possible interior conditions], Architektur und Technik 8/92, p. 49–53, B+L Verlags AG, Schlieren (Switzerland)), to cool rooms by means of cooling elements which are preferably arranged in the ceiling area and through which usually there flows a heat transfer medium cooled in a central refrigerating unit. In this case, the cooling takes place by convective heat exchange of the cooling element with the air in the room and in particular by direct radiation exchange of the same with the objects located in the room.

The cooling capacity of such cooling elements is limited by the fact that their surface temperature must not drop below the dew point, since otherwise condensate forms during the cooling phases, which usually coincide with the times during which the room is in use. Although it has been proposed (WO-A-91/13 294) to cool below the dew point and to drain the condensate produced away by means of condensate channels or trays, it must be assumed that the formation of condensate during use of the climatically conditioned room is always problematical and undesired.

Also known (from DE-A-28 02 550) is a device for drying and cooling air in which the air is sucked by means of a fan over a cooling element which is temporarily cooled below the freezing point and which is freed of deposited frost by heating during short regeneration phases. However, such devices are not suitable for use in a room to be climatically conditioned and would therefore require air to be transported by forced convection, which would have to cause undesired drafts.

Since the dew point at the usually prevailing atmospheric moisture levels is around 12° C. to 15° C., if the formation of condensate is to be avoided in the case of a conventional cooling element arranged in the room to be cooled, the difference between the permissible temperature of the said element and the desired room temperature of about 22° C. is very small and the cooling capacity which can be achieved is correspondingly modest. As a result, very large cooled surfaces are required, which entails comparatively high costs and has the effect of restricting interior design possibilities.

SUMMARY OF THE INVENTION

It is the object of the invention to provide a remedy to the above limitations. The invention climatically conditions rooms in which the temperature of the cooling element is no longer restricted by the dew point.

The cooling apparatus according to the present invention comprises at least one cooling element having an upwardly facing cooling surface defining a circumference, at least one boundary strip sloping down towards the circumference, a condensate tray mounted below the circumference, and at least one discharge structure for receiving discharge from the condensate tray. Moreover, the mobile cooling unit according to the present invention comprises a stand for carrying the cooling element, wherein the circumference of the cooling element is surrounded by an intercepting strip with a boundary portion spaced from the circumference of the cooling element.

In general, the fundamental idea is to cool the cooling element during cooling phases, which coincide to a great extent with the times during which the climatically conditioned room is in use, to such an extent that condensate deposited on the said element quickly turns to ice and, as a result, no problematical condensation water is produced. During regeneration phases, which are generally chosen to be outside the times of use, the frozen condensate is melted off and drained away in liquid form.

The advantages achieved by the invention are particularly associated with the fact that the temperature of the cooling element can be set as low as desired. As a result, very high cooling capacities can be achieved even with small cooling surfaces, even if the heat exchange with the room to be climatically conditioned takes place mainly by means of radiation and free convection. This effect is further promoted by the fact that, in the infrared range, ice has radiation properties very similar to those of a black body and the icing of the cooling element has an entirely favorable effect on the decisive direct or indirect radiation exchange with objects in the climatically conditioned room. The cooling elements can consequently be kept small and simple in construction, whereby, of course, the costs are reduced and no longer play the previous restrictive role as a factor to be taken into account in interior design.

In addition, another problem is solved, one which until now presented difficulties with generic methods of climatically conditioning rooms and could only be dealt with by exchanging the air in the room, which however, requires additional installations and entails the risk of undesired drafts being produced.

In particular, if the room is being used for a considerable period of time by a high concentration of people, the humidity of the air in the room increases rapidly. This is perceived as unpleasant, and often leads to the attempt to remedy the situation by opening the windows; this however, in the summer months in particular, often further aggravates the problem owing to the high humidity of the outside air. The high atmospheric humidity may finally result in, even with the cooling elements at a relatively high temperature, the risk of condensation and of the cooling. system being switched off entirely by dew-point monitors. Consequently, the cooling is shut down at the very time it is needed most urgently.

By contrast, in the case of the present invention, atmospheric moisture is bound on the cooling element by the icing of condensate. As a result, the air in the room remains dry, which makes conditions considerably more comfortable and does not allow difficulties of the kind described previously to arise at all.

It is to be understood that both the foregoing general description and the following detailed description are exemplary only and are not restrictive of the invention as claimed.

BRIEF DESCRIPTION OF THE DRAWINGS

The invention is explained in more detail below with reference to figures, which merely illustrate exemplary embodiments, in which.

DESCRIPTION OF THE PREFERRED EMBODIMENTS

Figure 1:
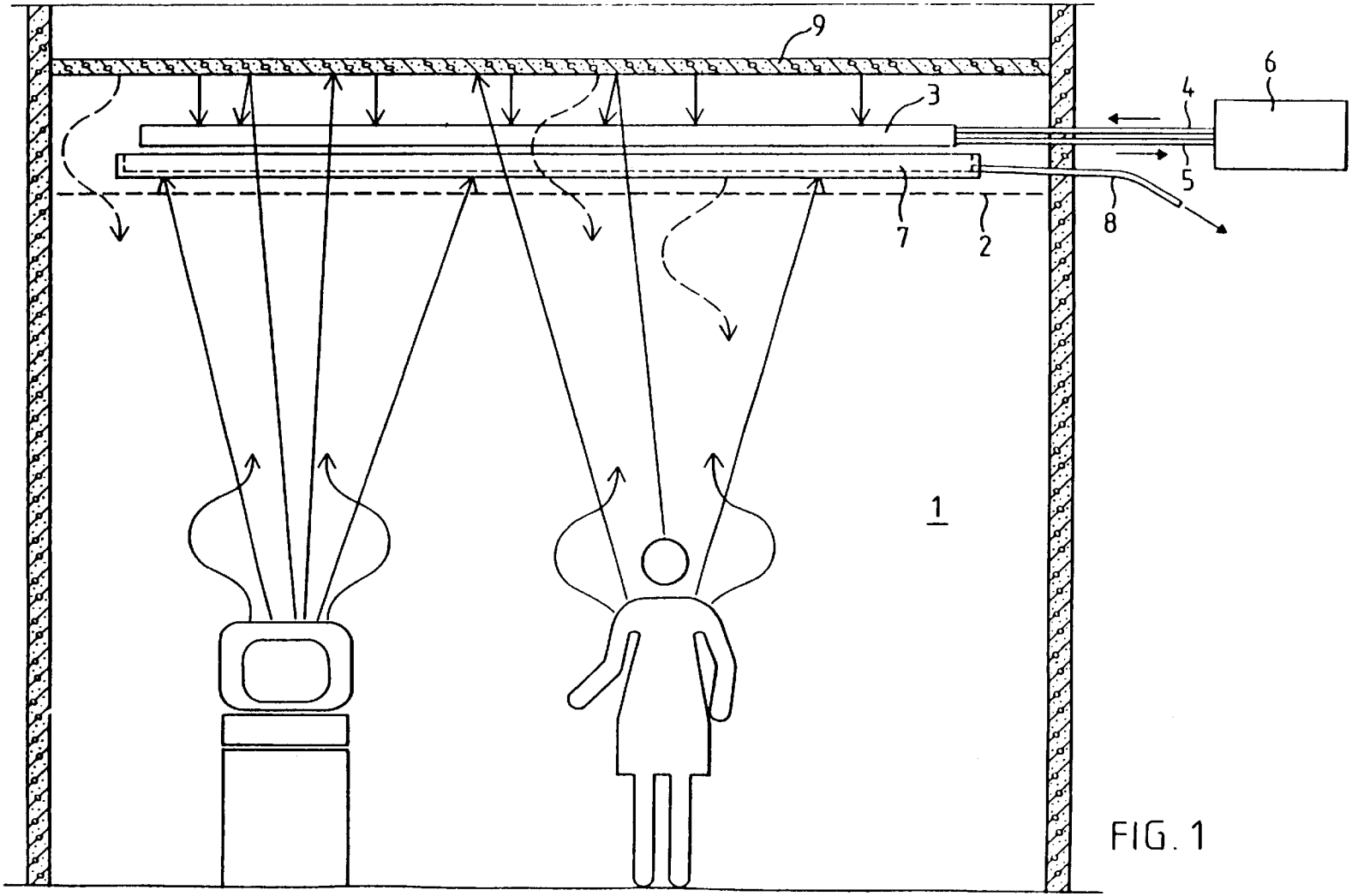
FIG. 1 is a cross section through a room that is climatically conditioned by the method according to the present invention.

A room 1 to be climatically conditioned (FIG. 1) usually contains heat-emitting objects, such as people and equipment, which exchange heat with a cooling apparatus through a perforated ceiling 2. The cooling apparatus includes at least one cooling element 3, which is connected by means of a feed line 4 and a draining line 5 directly or indirectly to a refrigerating unit 6. The cooling apparatus also includes condensate tray 7, which is arranged vertically below the cooling element 3, is of a slightly larger surface area than the cooling element and has a discharge 8. The cooling apparatus is prefereably arranged above the perforated ceiling 2. It is also possible, however, to integrate the condensate tray 7 into the ceiling 2, for example in such a way that it replaces a ceiling panel. Above the cooling apparatus, preferably about 20–30 cm away from the cooling element, there is incorporated a ceiling or intermediate ceiling 9 of concrete or plaster.

During a cooling phase, the cooling element 3 is cooled below the freezing point, to at least −5° C., but preferably much lower, for example −40° C. Usually, condensate is then soon deposited on the cooling element, immediately turns to ice and is consequently bound to the cooling element. The cooling of the room 1 takes place predominantly by radiation exchange via the intermediate ceiling 9, which is intensely cooled by direct radiation exchange with the iced cooling element, since, in the infrared range, the iced cooling element is very similar to an ideal black body and absorbs very efficiently the radiation emanating from the intermediate ceiling 9, whereas for its part, on account of its low temperature, the iced cooling element radiates much less heat towards the intermediate ceiling 9.

On the other hand, the intermediate ceiling 9 exchanges heat radiation with the room 1, in particular with any heat-emitting objects in it, through the perforated ceiling 2. It absorbs part of the heat radiation emanating from these objects and, on account of the lower temperature of the intermediate ceiling, it radiates less heat than it absorbs. Part of the radiation reaching the intermediate ceiling 9 is, of course, reflected and partly absorbed by the cooling element 3. The condensate tray 7 is also cooled by radiation exchange with the cooling element 3, and for its part, contributes to the cooling of the room 1 by radiation exchange with it. However, the temperature on the outside of the condensate tray 7 must not fall below the dew point, since otherwise condensate would form on its underside posing a potential problem to users of the room. The heat exchange by radiation is indicated in FIG. 1 by straight arrows.

In addition, convective heat exchange of the room 1 also occurs of course, in particular with the intermediate ceiling 9 but also directly with the cooling apparatus. In FIG. 1, this is indicated for the rising hot air by solid curved arrows and for the falling cold air by dashed curved arrows. However, the convection plays only a secondary role.

Due to the great temperature difference between the cooling element 3 and the room 1, which may well be 60° C., the cooling effect of the radiation exchange, which as known follows a $T^4$ law, is very high. As a result, an intense cooling effect can be achieved even with a small cooling element 3. Moreover, the air in the room 1 always remains relatively dry, since excess atmospheric moisture precipitates on the cooling element 3 and turns to ice. In this way, the most comfortable room conditions are established without further measures.

During a lengthy cooling phase, a relatively large amount of ice precipitates on the cooling element and has ultimately to be thawed and drained away during a regeneration phase, which is usually arranged to be performed at a time during which the room 1 is not being used. It is usually sufficient for thawing to simply switch off the refrigerating unit and to allow the ice deposited on the cooling element 3 to melt off by heat exchange with the surrounding atmosphere. It is also possible to perform a rapid regeneration by heating of the cooling element 3. The melted-off water is cooled by the condensate tray 7 and drained away via the discharge 8. After the ice has melted off completely, or possibly even only partially, the cooling apparatus is ready for use again.

Figure 2A:
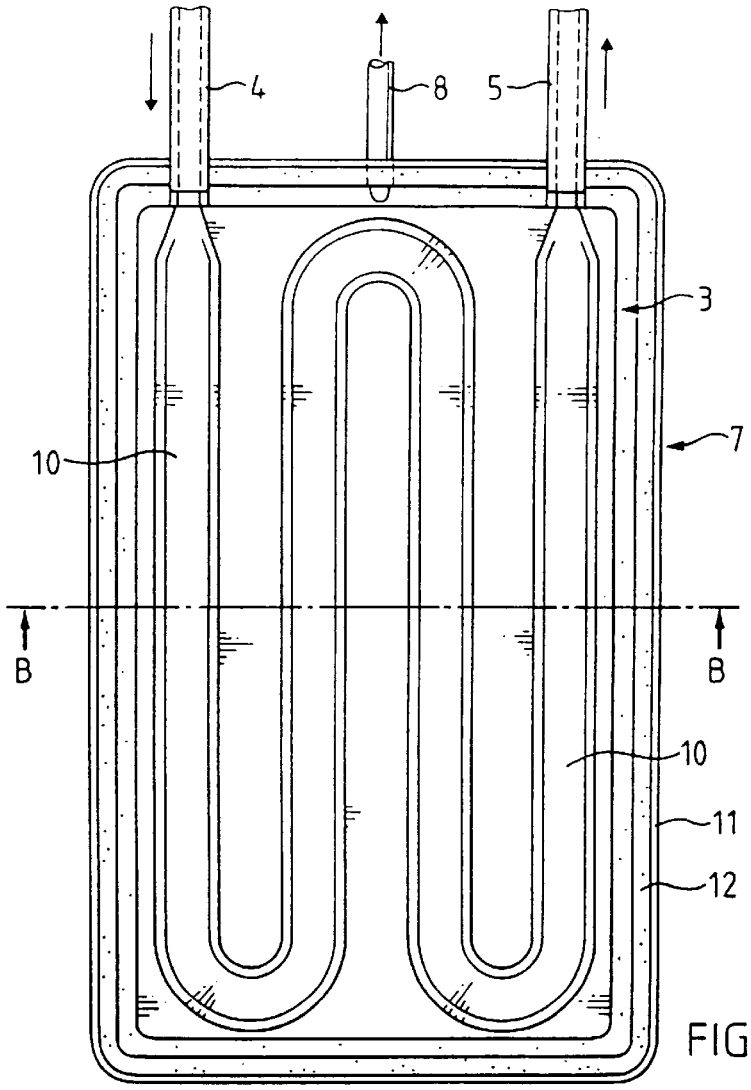
FIG. 2*a* is a plan view of a first embodiment of an apparatus according to the invention for carrying out the method according to the present invention.
Figure 2B:
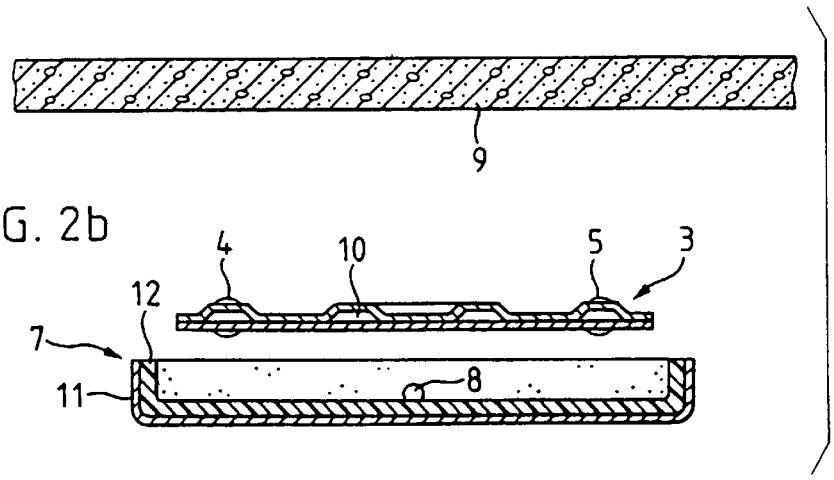
FIG. 2*b* is a cross-section along line B—B through the apparatus of FIG. 2*a*.

According to a first embodiment of a cooling apparatus (FIGS. 2*a, b*), the cooling element 3 is designed as an evaporator made of sheet steel, which is connected via a heat-insulated feed line 4 and a similar draining line 5 to the refrigerating unit 6 (FIG. 1), which in this case is designed as a condenser. Liquid refrigerant, for example Freon, is channeled into the evaporator through the feed line 4, is evaporated in a meandering passage 10, connecting the feed line 4 to the draining line 5, and as a result cools the cooling element to about −40° C. The vapour is led by the draining line 5 back to the refrigerating unit 6 and is condensed there by heat extraction.

The condensate tray 7, arranged below the cooling element 3, has an outer shell 11 made of steel, which is powder-coated on the outside, so that it absorbs well there to prevent formation of condensation and an inner shell 12 of polyurethane or rockwool, or some other material of low thermal conductivity, which is inserted into the outer shell 11. On the inside, it is provided with a lining 11*a* of reflective metal foil. By the construction described, cooling of the outside of the condensation tray 7 below the dew point is generally prevented. If these measures are not sufficient, the outer shell 11 may be slightly heated. To facilitate drainage of condensate, the condensate tray 7 is made to slope slightly towards the discharge 8.

To facilitate the radiation exchange of the cooling element 3 with the room 1 via the intermediate ceiling 9, the cooling apparatus is arranged at a distance below the intermediate ceiling 9. The part of the intermediate ceiling 9 lying above the cooling element 3 is intensely cooled by radiation exchange with the cooling element and for its part cools the room 1 by radiation exchange. This effect is assisted by heat conduction in the intermediate ceiling 9. The radiation exchange with the intermediate ceiling 9 may—at least in the initial phase of a cooling phase when no ice layer has yet formed—be further intensified by the cooling element 3 being provided on the upper side with a coating which absorbs well. By contrast, its underside, facing the condensate tray 7, is preferably reflective.

Figure 3A:
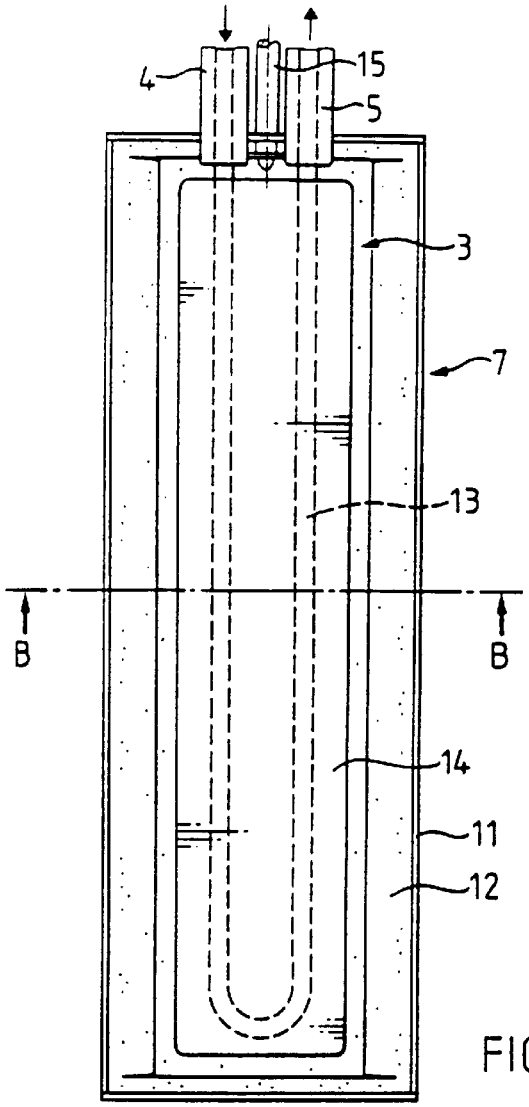
FIG. 3*a* is a plan view of a second embodiment of an apparatus according to the present invention for carrying out the method according to the present invention.
Figure 3B:
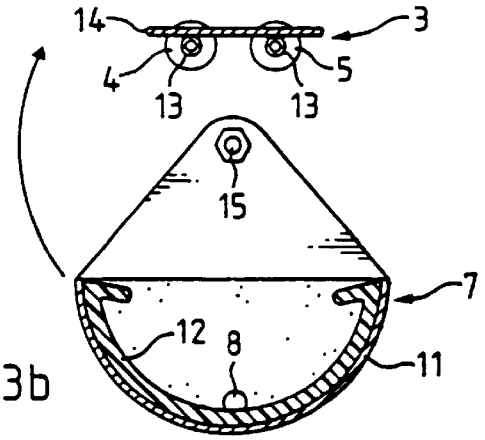
FIG. 3*b* is a cross-section along line B—B through the apparatus of FIG. 3*a*.
Figure 4A:
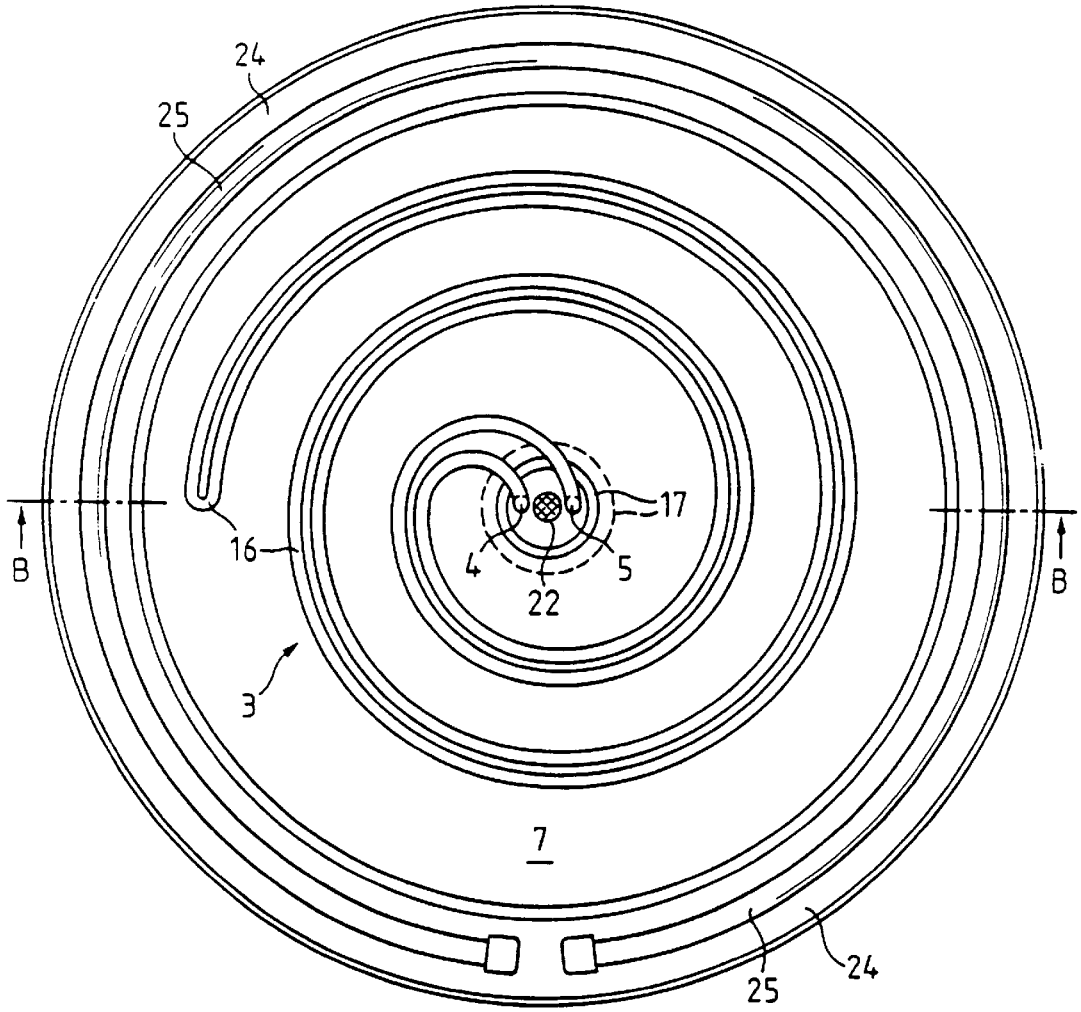
FIG. 4*a* is a plan view of a third embodiment of an apparatus according to the present invention for carrying out the method according to the present invention.
Figure 4B:
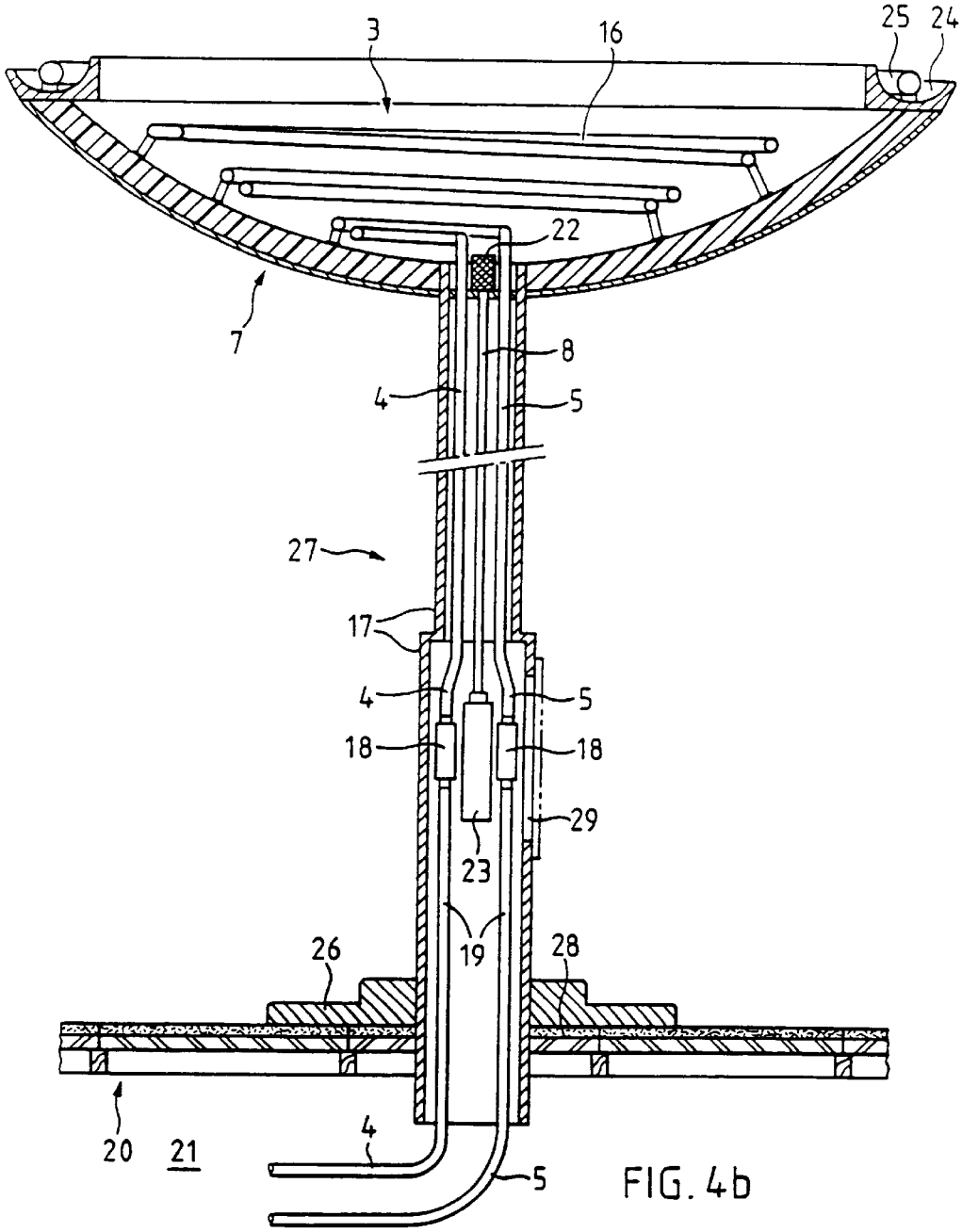
FIG. 4*b* is a cross-section along line B—B through the apparatus of FIG. 4*a*.

In the case of a second embodiment of the cooling apparatus (FIGS. 3*a, b*), the cooling element 3 is designed as a steel tube 13 bent in the shape of a U, through which brine cooled to about −40° C. in the refrigerating unit 6 (FIG. 1) is channeled. To intensify the radiation exchange with the intermediate ceiling 9, the steel tube 13 bears on the upper side a steel plate 14, to which it is welded. The steel plate may be coated matt-black on the upper side to enhance the cooling effect.

The condensate tray 7 is of basically the same construction as described in the first exemplary embodiment, but maybe fastened on a pivotable spindle 15 extending parallel to its longitudinal axis, so that it can be pivoted to the side through about 90° (arrow) out of its position below the cooling element 3. The cooling element 3 is then exposed and can enter into direct radiation exchange with objects in the room 1. In this way, a particularly intense cooling effect can be achieved, as may be desired for example when cooling down an overheated room at the beginning of a cooling phase. The edges of the condensate tray 7 are bent inwardly slightly, so that any residual condensate cannot run out during pivoting of the tray.

According to a third embodiment of the cooling apparatus, the condensate tray 7 is designed as a flat dish of, for example, the shape of a spherical cup. The cooling element 3 is designed as part of a copper tube which is bent to form a double spiral 16 and, at the center of the condensate tray 7, merges into a heat-insulated feed line 4 and a similar draining line 5, which are drawn into a further tube 17 made of sheet steel. At the outer end, the double spiral 16 may be provided with a venting valve. The ends of the copper tube 16 are adjoined there, via two rapid action couplings 18, to two likewise heat-insulated hoses 19, which are led through the tube 17 into a hollow floor 21, situated between a floor 20 and a concrete base (not shown), and are connected to permanently laid lines which establish the connection to the refrigerating unit 6 (FIG. 1) and carry brine or glycol as the cooling medium. Likewise arranged at the center of the condensate tray 7 is a filter 22, which adjoins a discharge 8 for the melted-off water resulting from the regeneration phase, and which ends in a collecting tank 23. The condensate tray 7 is of basically the same construction as described in the first exemplary embodiment. However, it additionally bears a lighting element, a fluorescent tube 25, running around above a reflector 24, for indirect illumination. Of course, additional lighting elements may be provided for direct illumination.

The tube 17, together with a base plate 26 surrounding it, forms a stand 27, which bears the cooling element 3 and the condensate tray 7. The base plate 26 bears on the underside a base element 28, which can be used at various points of the floor 20, in that it replaces there a normal floor element, for example. Slightly above the base plate 26, the tube 17 has an opening 29, which can be closed by a cover and behind which the rapid action couplings 18 and the collecting tank 23 are situated and can be accessed.

In the case of this configuration, it is very easily possible to move the cooling apparatus elsewhere, by releasing the rapid action couplings 18 and lifting the stand 27 with the floor element 28 out of the floor 20 and replacing the element by a normal floor element. Subsequently, the cooling apparatus can be used at another point of the floor and be connected again via the rapid action couplings 18 to heat-insulated hoses, which establish the connection with permanently laid lines. This offers the possibility of assigning a single cooling apparatus to one workplace, for example, and moving it, if need be, with the workplace as well. It is then possible with comparatively low expenditure and, under certain circumstances, significantly reduced energy consumption, to produce a pleasant climate in the direct vicinity of the workplace, without it being necessary to cool the entire, possibly much larger, room. In the example described, a workplace light is integrated at the same time into the cooling apparatus, designed in this way as a workplace cooler. With the compact design of the cooling apparatus as a workplace cooler, use is made in a particularly advantageous way of the high cooling capacity which the method according to the invention offers.

The design described can be modified in a wide variety of ways. For instance, instead of the collecting tank 23, there may be provided a further rapid action coupling, which connects the discharge to a further hose and also to a condensate discharge provided in the hollow floor.

On the condensate tray there may be provided fixed and adjustable reflectors, arranged above the cooling element, or other deflecting elements for thermal radiation, for influencing the spatial distribution of the cooling effect, and possibly also deflecting elements for light.

A further modification is the use of an evaporator or Peltier element instead of the double spiral 16 as the cooling element. A Peltier element makes it unnecessary—in particular when a collecting tank is being used for the melted-off water which then needs only to be emptied occasionally—for the feed line 4 and the draining line 5 for connecting the cooling element to the refrigerating unit to be produced partly by hoses, and allows them instead to be formed entirely or partially as cables and to be connected by a plug connection, similar to an electrical plug connection, to a suitable cooling installation, which may have, for example in each room, a heat exchanger, from which the heat generated by the Peltier element or plurality of Peltier elements is abducted and transported to the refrigerating unit by means of cooling medium. In this case, the stand may be provided with a flat base, so that the cooling device can be moved around freely in the room like a standard lamp.

Although the use of a Peltier element as a cooling element is particularly advantageous in the case of a moveable workplace cooler, it is of course also possible in the case of fixed cooling apparatuses.

According to a fourth embodiment of the invention (FIGS. 5*a–h*) which is a variant of the third embodiment, stand 27 of a mobile cooling unit comprises, besides tube 17 carrying a cooling apparatus with cooling element 3, a wheeled base 30 supporting the tube 17. In particular, tube 17 is a rectangular tube made of extruded aluminum. Cooling element 3 exhibits an upward-facing convex cooling surface. The base 30 also supports a sheet steel casing 31 containing a refrigerating unit 6.

As shown in FIGS. 5*a–c* and 5*g–h*, the cooling element 3 consists of four triangular cooling plates 32*a,b,c,d* connected at contiguous lateral edges to form a flat roof-shaped structure and whose lower edges form the circumference of the cooling element. Each one of the cooling plates 32*a,b,c,d* is an evaporator made up of a plane upper steel sheet 33 and a thin lower steel sheet 34 connected to the same, which is also essentially planar but provides a shallow trough-shaped depression meandering from the lower edge of the cooling plate up to its opposite corner. The depression forms a duct 35 enclosed between the steel sheets and bordered by weld seams 36 connecting the same. At one end, near the lower edge of the cooling plate, duct 35 is connected via a capillary 37 and a distributor 38 to common feed line 4. On the other hand, duct 35 is also connected, at the top of the cooling plate, to a thermally insulated common draining line 5. At the underside, the cooling element 3 is lined with an insulation layer 39.

Figure 5A:
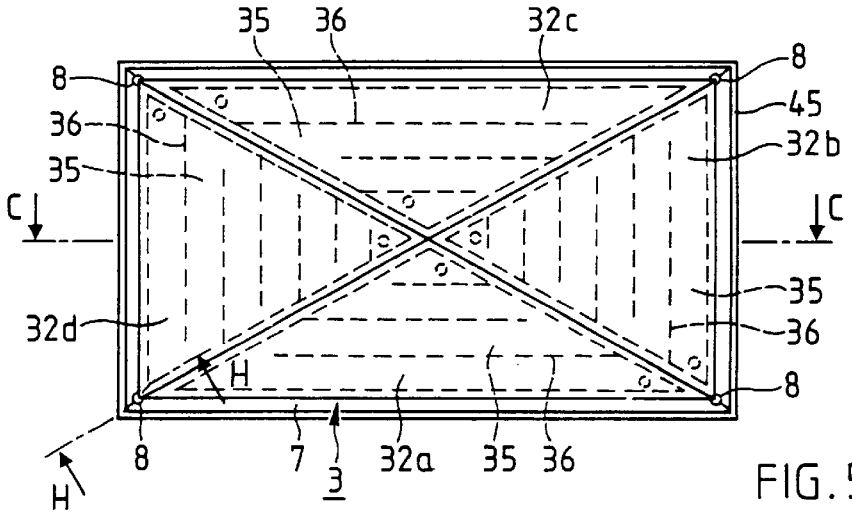
FIG. 5*a* is a top view of a cooling unit with an apparatus according to a fourth embodiment of the present invention.
Figure 5B:
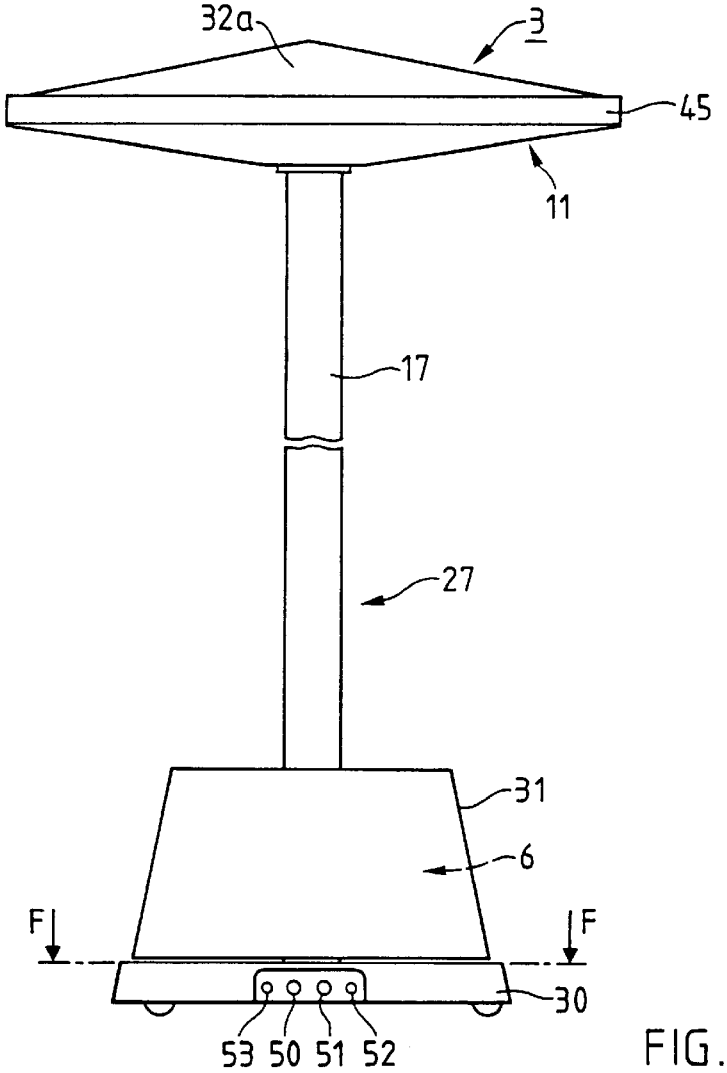
FIG. 5*b* is an elevational view of the cooling unit of FIG. 5*a*.
Figure 5C:
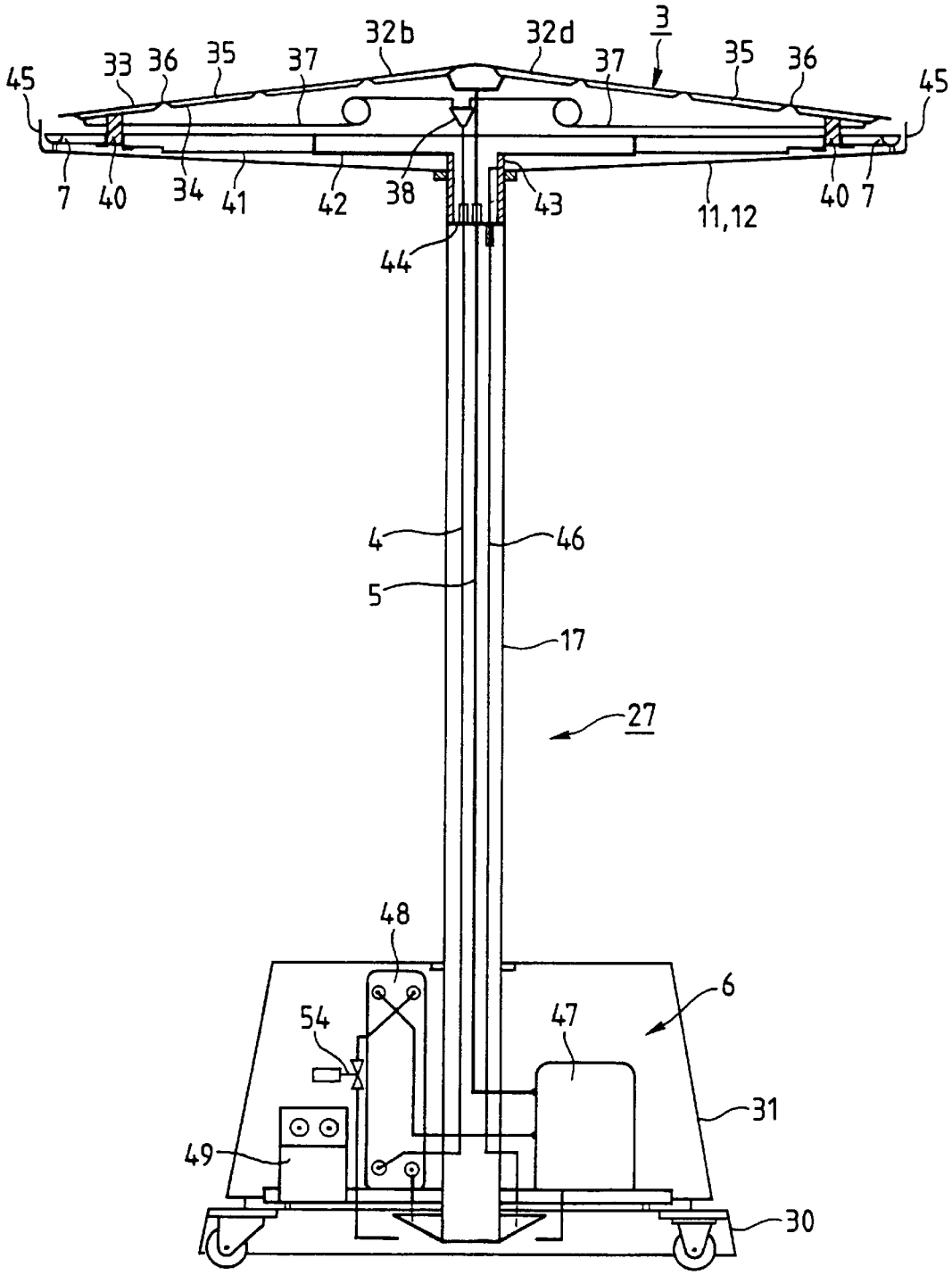
FIG. 5*c* is a cross-sectional view of the cooling unit of FIGS. 5*a* and 5*b* along line C—C through the apparatus of FIG. 5*a*.
Figure 5D:
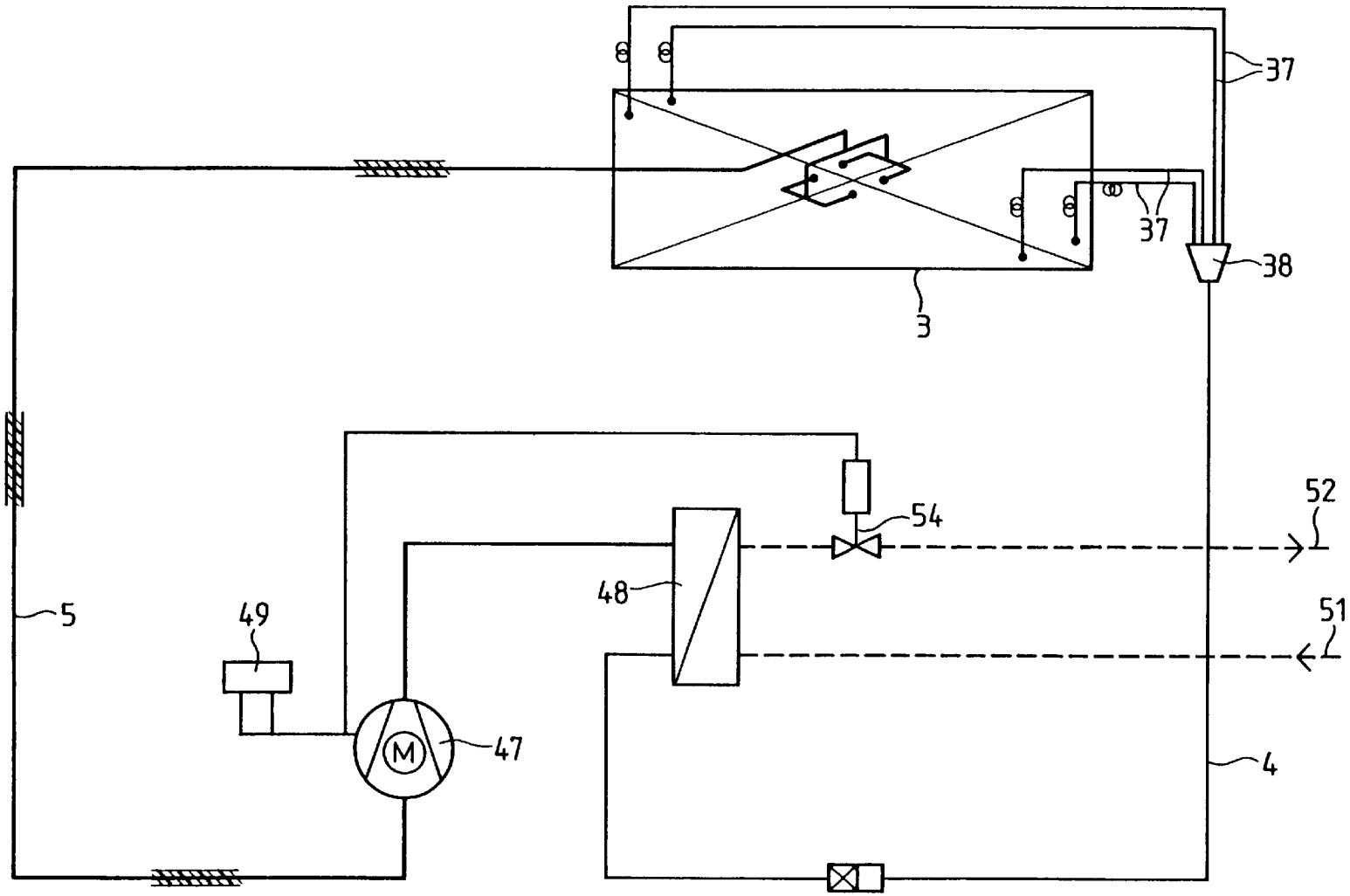
FIG. 5*d* is a flow diagram of the cooling circuit of the unit of FIGS. 5*a* and 5*b*.
Figure 5E:
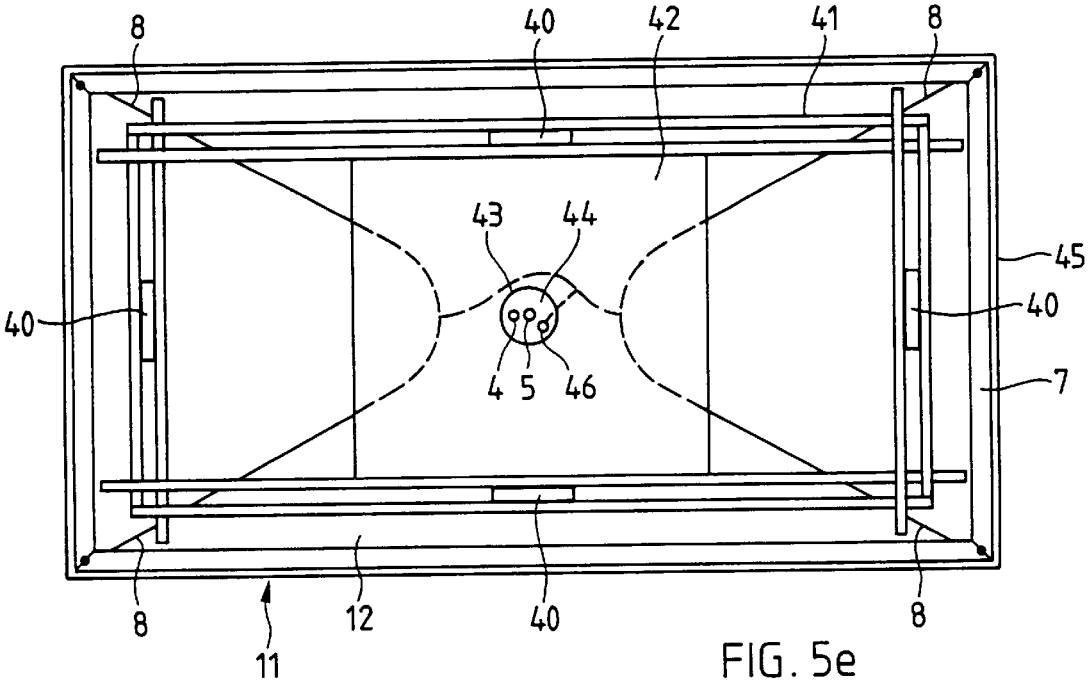
FIG. 5*e* is a top view of the cooling unit like FIG. 5*a*, but with the cooling element removed.
Figure 5F:
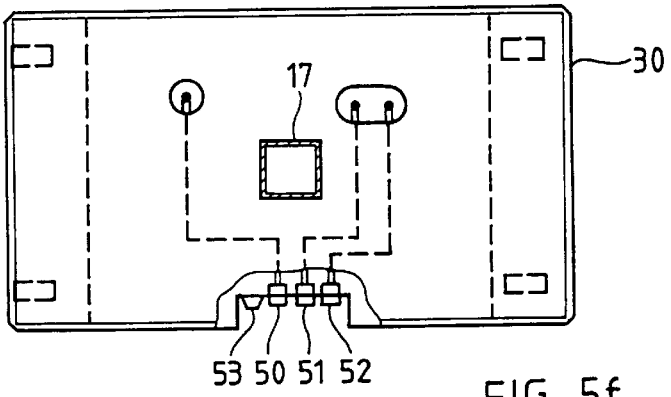
FIG. 5*f* is a top view of a part of the cooling unit according to FIGS. 5*a* and 5*b*, equivalent to a cross-sectional view along line F—F of FIG. 5*b*.
Figure 5G:
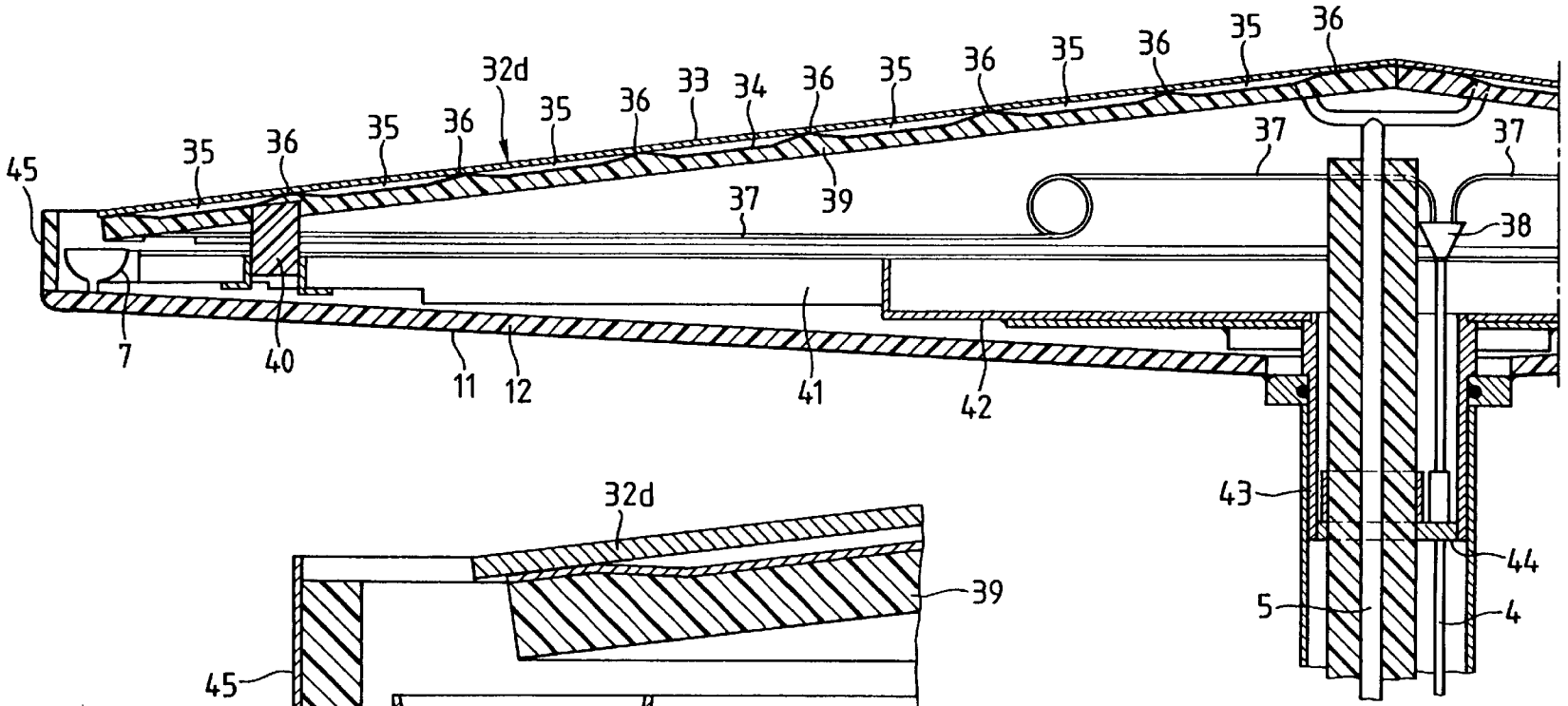
FIG. 5*g* is an enlarged cross-sectional view of a side portion of the cooling unit of FIG. 5*c*.

Cooling element 3 is supported by four support elements 40 made of plastic or some other material of low thermal conductivity and supported in turn by a frame 41 consisting of four pairs of aluminum profiles each of which is parallel to one of the sides, which make up the circumference of the cooling element 3, as shown in FIGS. 5*e* and 5*g*, for example. The frame 41 is connected to a support tray 42 carried by a tube section 43 inserted into the upper end of tube 17 and sealed by an end plate 44.

Figure 5H:
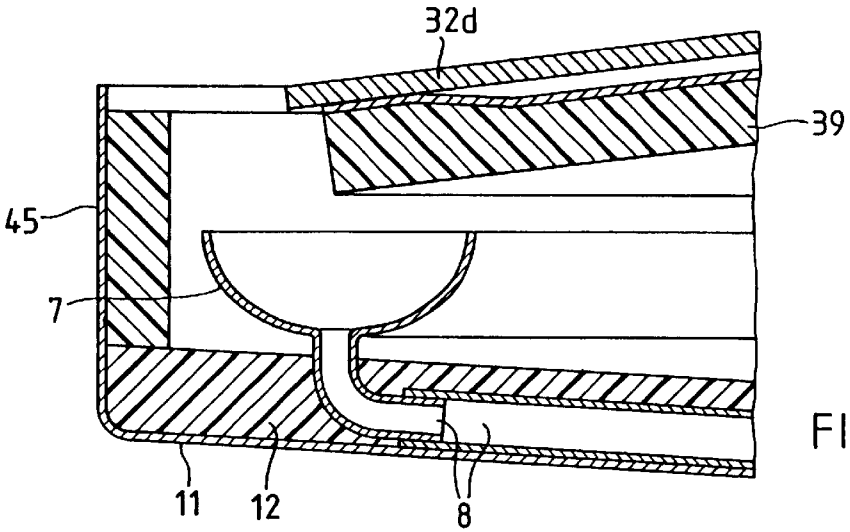
FIG. 5*h* is an enlarged cross-sectional view along line H—H of the cooling unit of FIG. 5*a*.

The rectangular outer shell 11, also supported by tube 17 and carrying an inner shell 12 of thermally insulating material, extends beyond the circumference of the cooling element 3 where it carries an upward-directed intercepting strip 45, which surrounds said circumference, being laterally spaced from the same and with its upper boundary portion essentially at the same level. The condensate tray 7 is shaped as a surrounding trough placed somewhat below the circumference of the cooling element 3 and within the intercepting strip 45. Moreover, condensate tray 7 is provided with discharges 8 which, following the outer shell 11, connect the corners of condensate tray 7 to a discharge line 46, as shown in FIGS. 5*g* and 5*h*, for example.

The refrigerating unit 6 comprises a compressor 47, a heat exchanger 48 and a pressostat 49, alternatively referred to as a "pressure sensor controller." The feed line 4, being guided inside tube 17 and through end plate 44, connects the heat exchanger 48 via the capillaries 37 to the ducts 35 in cooling plates 32*a,b,c,d*. Similarly, draining line 5 leads from cooling plates 32*a,b,c,d* down through end plate 44 and inside tube 17 to compressor 47. The discharge line 46 leads directly to a discharge connector 50 in base 30. As shown in FIGS. 5*b, d* and *f* for example, the heat exchanger 48 is connected to a cooling fluid feed connector 51 and a cooling fluid drain connector 52 and compressor 47 to an electrical connector 53, all equally in base 30. A valve 54 is built into the line connecting the heat exchanger 48 to the cooling fluid drain connector 52.

A liquid refrigerant, e. g. freon, flows from heat exchanger 48 through feed line 4, distributor 38, and capillaries 37 to the ducts 35 in each of the cooling plates 32*a,b,c,d* where it evaporates. As a result, cooling element 3 is preferably cooled down to about −40° C. as discussed above with respect to the other embodiments of the present invention. From the upper ends of ducts 35 the evaporated refrigerant is sucked via draining line 5 into compressor 47, which produces suction in draining line 5, where it is compressed, heating up at the same time. Compressor 47, which also drives the circulation of the refrigerant, is controlled by pressostat 49, which switches compressor 47 on and off depending on downstream pressure, to control the pressure of the refrigerant and, thereby, achieve efficient heat or coolant transfer between the refrigerant and the ambient air. For example, the pressure of the refrigerant is preferably controlled to achieve the cooling effects discussed above.

The hot refrigerant is cooled and liquefies in the heat exchanger 48 where the heat is taken up by a cooling fluid, preferably water entering the cooling unit via cooling fluid feed connector 51, which is connected to an appropriate tap by a hose. After being heated up in heat exchanger 48, the cooling fluid is drained via cooling fluid drain connector 52 and another hose connecting it to an appropriate drain. Valve 54 is closed by pressostat 49 whenever compressor 48 is switched off and no cooling fluid is needed.

Due to its large cooling surface the cooling element 3 has high cooling power, which is transferred to the ambient air unlike the case of the above-described third embodiment, that is achieved almost exclusively via radiation but also by free convection as a pronounced cold air flow pattern forms along the sloping cooling plates 32*a,b,c,d*. Compact gusts of cold air, which might otherwise compromise the comfort of a person placed below the cooling apparatus, are nevertheless avoided as the intercepting strip 45 whose upper boundary rises slightly above the sloping planes, as defined by plates 32*a,b,c,d* of cooling element 3, and forces the cold air to flow from the cooling element 3 to rise above said boundary and break up or disperse in the process. Consequently, the cold air mixes with ambient air before it sinks down to effect cooling about the neighborhood of the cooling unit.

As discussed above with respect to the other embodiments of the present invention, ice will form on the cooling surface during the cooling phases and melt during regeneration phases when the water will be drained via condensate tray 7, discharges 8, discharge line 46, and discharge connector 50 via a hose connected to an appropriate drain. Thanks to wheeled base 30, the mobile cooling unit can be easily moved around if required. Connections with water taps and drains as well as electric plugs can be easily formed and interrupted where necessary.

Other embodiments of the invention will be apparent to those skilled in the art from consideration of the specification and practice of the invention disclosed herein. It is intended that the specification and examples be considered exemplary only, with a true scope and spirit of the invention being indicated by the following claims.

What is claimed is:

1. A cooling apparatus for climatically conditioning a room comprising:

at least one cooling element having an upwardly facing cooling surface defining a circumference and at least one boundary strip of the cooling surface adjacent to and sloping down towards the circumference;

a condensate tray mounted below the circumference; and at least one discharge structure for receiving discharge from the condensate tray.

2. The cooling apparatus according to claim 1, wherein the at least one cooling element includes an essentially roof-shaped structure consisting of several contiguous cooling plates.

3. The cooling apparatus according to claim 2 where the cooling plates are triangular.

4. The cooling apparatus according to claim 2 where the cooling plates are evaporators.

5. The cooling apparatus according to claim 1, further comprising an intercepting strip having a boundary portion spaced from the circumference of the cooling surface and rising at least to the level of the circumference.

6. The cooling apparatus according to claim 5, where the condensate tray is trough-shaped and situated below the circumference of the cooling element and within the intercepting strip.

7. The mobile cooling unit of claim 1, further comprising a refrigerating unit connected to the cooling element by a feed line and a draining line.

8. The mobile cooling unit of claim 1, wherein the stand comprises a refrigerating unit connected to the cooling element by a feed line and a draining line.

9. The mobile cooling unit of claim 7, where the refrigerating unit comprises a compressor and a heat exchanger.

10. The mobile cooling unit of claim 9, further comprising a cooling fluid feed connector, a cooling fluid drain connector, and an electrical connector.

11. The mobile cooling unit of claim 9, further comprising a discharge connector.

12. A mobile cooling unit for climatically conditioning a room comprising:

a cooling element having an upwardly facing cooling surface defining a circumference and at least one boundary strip of the cooling surface adjacent to and sloping down towards the circumference;

a condensate tray mounted below the circumference; and at least one discharge structure for receiving discharge from the condensate tray; and a stand for carrying the cooling element.

13. The mobile cooling unit of claim 12, further comprising a wheeled base for supporting the stand.

14. The mobile cooling unit of claim 12, further comprising a duct meandering under the cooling surface.

15. The mobile cooling unit of claim 7, wherein the cooling element comprises an upper plate defining the upwardly facing cooling surface and a lower the plate connected to the upper plate so as to define a trough-shaped depression between the upper and lower plates forming a duct for a cooling medium.

16. The mobile cooling unit of claim 15, wherein the trough-shaped depression is connected to a feed line and a draining line.

17. The mobile cooling unit of claim 12, wherein the circumference of the cooling surface is surrounded by an intercepting strip having a boundary portion laterally spaced from the circumference of the cooling surface and rising at least to the level of the circumference.

* * * * *

UNITED STATES PATENT AND TRADEMARK OFFICE

CERTIFICATE OF CORRECTION

PATENT NO. : 6,263,690 B1
DATED : July 24, 2001
INVENTOR(S) : Sokolean et al.

It is certified that error appears in the above-identified patent and that said Letters Patent is hereby corrected as shown below:

Column 10, claim 15,
Line 15, "claim 7" should read -- claim 12 --.
Line 17, "lower the plate" should read -- lower plate --.

Signed and Sealed this

Twenty-ninth Day of January, 2002

*Attest:*

*Attesting Officer*

JAMES E. ROGAN
*Director of the United States Patent and Trademark Office*